US008672158B2

(12) United States Patent
Taber et al.

(10) Patent No.: US 8,672,158 B2
(45) **Date of Patent: *Mar. 18, 2014**

(54) IMPACT RESISTANT CLOSURE

(75) Inventors: James M. Taber, Aurora, IL (US); Darren R. Neputy, Palos Hills, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 43 days.

This patent is subject to a terminal disclaimer.

(21) Appl. No.: 13/535,107

(22) Filed: Jun. 27, 2012

(65) Prior Publication Data

US 2012/0261420 A1 Oct. 18, 2012

Related U.S. Application Data

(63) Continuation of application No. 12/788,825, filed on May 27, 2010, now Pat. No. 8,231,020.

(51) Int. Cl.
*B65D 43/14* (2006.01)

(52) U.S. Cl.
USPC ..... 215/305; 215/329; 215/228

(58) Field of Classification Search
USPC ..... 215/329, 305, 288, 252
See application file for complete search history.

(56) References Cited

U.S. PATENT DOCUMENTS

| | | | |
|---|---|---|---|
| 3,251,498 | A | 5/1966 | Roy et al. |
| 3,601,273 | A | 8/1971 | Kutcher et al. |
| 3,637,073 | A | 1/1972 | Capuano |
| 3,796,338 | A | 3/1974 | Wilton |
| 3,805,987 | A | 4/1974 | Horvath |
| 3,871,544 | A | 3/1975 | Peyser |
| 3,946,889 | A | 3/1976 | Gach |
| 4,076,139 | A | 2/1978 | Larson |
| 4,153,174 | A | 5/1979 | Keeler |
| 4,157,143 | A | 6/1979 | Doi |
| 4,278,180 | A | 7/1981 | Willis |
| 4,352,436 | A | 10/1982 | Chartier et al. |
| RE31,496 | E | 1/1984 | Keeler |
| 4,454,954 | A | 6/1984 | Willis |
| 4,505,401 | A | 3/1985 | Berglund |
| 4,540,100 | A | 9/1985 | Willis |
| 4,550,845 | A | 11/1985 | Guala |

(Continued)

FOREIGN PATENT DOCUMENTS

| | | | |
|---|---|---|---|
| AR | 248252 | A1 | 7/1995 |
| AT | 319792 | B | 1/1975 |

(Continued)

OTHER PUBLICATIONS

Silgan White Cap LLC Brochure, "Plasti-Twist TM Plus—38mm VAJ," 2008.

(Continued)

*Primary Examiner* — Anthony Stashick
*Assistant Examiner* — James N Smalley
(74) *Attorney, Agent, or Firm* — Reinhart Boerner Van Deuren s.c.

(57) ABSTRACT

A closure including a top panel and a transition section extending from a peripheral edge of the top panel is provided. The closure includes a skirt extending from a peripheral edge of the transition section such that the skirt extends away from the top panel. The skirt includes a plurality of projections extending outwardly and away from an outer surface of the transition section.

19 Claims, 7 Drawing Sheets

(56) References Cited

U.S. PATENT DOCUMENTS

| | | | |
|---|---|---|---|
| 4,573,601 | A | 3/1986 | Berglund |
| 4,592,476 | A | 6/1986 | Yasada |
| 4,597,500 | A | 7/1986 | Stubbs |
| 4,638,917 | A | 1/1987 | Persch |
| 4,991,729 | A | 2/1991 | Hunter |
| 5,000,992 | A | 3/1991 | Kelch |
| 5,064,084 | A | 11/1991 | McBride et al. |
| 5,090,582 | A | 2/1992 | Art et al. |
| 5,129,530 | A | 7/1992 | Fuchs |
| 5,174,465 | A | 12/1992 | Luch et al. |
| 5,213,224 | A | 5/1993 | Luch |
| 5,244,107 | A | 9/1993 | Battegazzore |
| 5,249,695 | A | 10/1993 | Luch et al. |
| 5,271,519 | A | 12/1993 | Adams et al. |
| 5,303,837 | A | 4/1994 | Adams et al. |
| 5,317,796 | A | 6/1994 | Hunter |
| 5,348,182 | A | 9/1994 | Luch |
| 5,348,183 | A | 9/1994 | Luch et al. |
| 5,348,184 | A | 9/1994 | Adams et al. |
| 5,351,845 | A | 10/1994 | Hunter |
| 5,381,912 | A | 1/1995 | Walker et al. |
| 5,397,013 | A | 3/1995 | Adams et al. |
| 5,402,901 | A | 4/1995 | Carvalheiro et al. |
| 5,445,283 | A | 8/1995 | Krautkramer |
| 5,460,283 | A | 10/1995 | MaCartney et al. |
| 5,487,481 | A | 1/1996 | Sander et al. |
| 5,512,228 | A | 4/1996 | Adams et al. |
| 5,597,082 | A | 1/1997 | Luch et al. |
| 5,609,262 | A | 3/1997 | Trout |
| 5,673,809 | A | 10/1997 | Ohmi et al. |
| 5,676,269 | A | 10/1997 | Blake et al. |
| 5,678,719 | A | 10/1997 | Adams et al. |
| 5,680,945 | A | 10/1997 | Sander et al. |
| 5,893,475 | A | 4/1999 | May |
| D413,202 | S | 8/1999 | Schmitt et al. |
| D418,756 | S | 1/2000 | Reidenbach |
| D418,757 | S | 1/2000 | Reidenbach |
| 6,039,198 | A | 3/2000 | Wolfe et al. |
| 6,123,212 | A | 9/2000 | Russell et al. |
| 6,149,023 | A | 11/2000 | Palmer |
| 6,182,845 | B1 | 2/2001 | Wolfe et al. |
| 6,199,696 | B1 | 3/2001 | Lytle et al. |
| 6,283,318 | B1 | 9/2001 | Lee |
| 6,431,385 | B1 | 8/2002 | Palmer |
| 6,557,714 | B2 | 5/2003 | Babcock et al. |
| 6,646,864 | B2 | 11/2003 | Richardson |
| 6,733,852 | B2 | 5/2004 | Littlejohn et al. |
| D506,359 | S | 6/2005 | Zettle et al. |
| 6,995,976 | B2 | 2/2006 | Richardson |
| 7,011,221 | B2 | 3/2006 | Smith et al. |
| D525,125 | S | 7/2006 | King |
| D525,523 | S | 7/2006 | King |
| 7,077,278 | B2 | 7/2006 | Dubach |
| 7,158,376 | B2 | 1/2007 | Richardson et al. |
| 7,180,735 | B2 | 2/2007 | Thomas et al. |
| D538,654 | S | 3/2007 | Seidita |
| 7,207,453 | B2 | 4/2007 | Rossi |
| D542,654 | S | 5/2007 | Szczesniak |
| D542,655 | S | 5/2007 | Szczesniak |
| D542,656 | S | 5/2007 | Szczesniak |
| 7,230,823 | B2 | 6/2007 | Richardson et al. |
| 7,258,905 | B2 | 8/2007 | Whitemore et al. |
| 7,312,984 | B2 | 12/2007 | Thomas et al. |
| 7,314,146 | B2 | 1/2008 | Mavin |
| D574,240 | S | 8/2008 | Szczesniak |
| D587,115 | S | 2/2009 | Capretta et al. |
| 7,527,161 | B2 | 5/2009 | Rodriguez et al. |
| D597,793 | S | 8/2009 | Krueger et al. |
| 7,575,121 | B2 | 8/2009 | Ooka et al. |
| 7,609,512 | B2 | 10/2009 | Richardson et al. |
| D603,222 | S | 11/2009 | Kruger et al. |
| 7,663,879 | B2 | 2/2010 | Richardson et al. |
| 7,688,580 | B2 | 3/2010 | Richardson et al. |
| 7,721,911 | B2 | 5/2010 | Chou |
| 2002/0122907 | A1 | 9/2002 | Whitemoore et al. |
| 2002/0175171 | A1 | 11/2002 | Stewart et al. |
| 2003/0034351 | A1 | 2/2003 | Van Handel et al. |
| 2003/0176548 | A1 | 9/2003 | Goldman |
| 2004/0007556 | A1 | 1/2004 | Manera et al. |
| 2004/0026354 | A1 | 2/2004 | Folchini et al. |
| 2005/0092750 | A1 | 5/2005 | Lohrman et al. |
| 2005/0145638 | A1 | 7/2005 | Van Handel et al. |
| 2006/0032831 | A1 | 2/2006 | Major |
| 2006/0102584 | A1 | 5/2006 | Wellman |
| 2006/0124575 | A1 | 6/2006 | Mavin et al. |
| 2006/0231519 | A1 | 10/2006 | Py et al. |
| 2007/0034590 | A1 | 2/2007 | Hidding |
| 2007/0095835 | A1 | 5/2007 | Lohrman et al. |
| 2008/0067142 | A1 | 3/2008 | Druitt |
| 2008/0087625 | A1* | 4/2008 | Kumata et al. ..... 215/252 |
| 2008/0092627 | A1* | 4/2008 | Hadley et al. ..... 73/23.42 |
| 2008/0110848 | A1 | 5/2008 | Lantos et al. |
| 2008/0169261 | A1 | 7/2008 | Druitt et al. |
| 2008/0179276 | A1 | 7/2008 | Lohrman et al. |
| 2008/0251489 | A1 | 10/2008 | Livingston et al. |
| 2008/0251490 | A1 | 10/2008 | Livingston et al. |
| 2008/0272083 | A1 | 11/2008 | Druitt |
| 2008/0272084 | A1 | 11/2008 | Lohrman et al. |
| 2008/0314000 | A1 | 12/2008 | Druitt |
| 2009/0009945 | A1 | 1/2009 | Johnson et al. |
| 2009/0020494 | A1 | 1/2009 | Seehofer |
| 2009/0034169 | A1 | 2/2009 | Richardson et al. |
| 2009/0039083 | A1 | 2/2009 | Stull et al. |
| 2010/0008028 | A1 | 1/2010 | Richardson et al. |
| 2010/0072163 | A1 | 3/2010 | Krause |
| 2010/0140268 | A1 | 6/2010 | Lohrman |

FOREIGN PATENT DOCUMENTS

| | | | |
|---|---|---|---|
| AU | 653779 | B2 | 10/1994 |
| AU | 664730 | B2 | 11/1995 |
| AU | 666683 | B2 | 2/1996 |
| AU | 668541 | B2 | 5/1996 |
| AU | 676009 | B2 | 2/1997 |
| AU | 696551 | B2 | 9/1998 |
| AU | 701983 | B2 | 2/1999 |
| AU | 752149 | B2 | 9/2002 |
| AU | 2002336000 | A1 | 10/2002 |
| AU | 761701 | B2 | 6/2003 |
| AU | 2003/239915 | A1 | 12/2003 |
| AU | 2004243320 | A1 | 12/2004 |
| AU | 2005275107 | A1 | 2/2006 |
| AU | 2005279311 | A1 | 3/2006 |
| AU | 2005209675 | A1 | 6/2006 |
| AU | 2005331483 | A1 | 11/2006 |
| AU | 2006332049 | A1 | 8/2007 |
| AU | 2006332049 | A2 | 8/2007 |
| AU | 2008/243010 | A1 | 10/2008 |
| AU | 2006332049 | A8 | 3/2009 |
| AU | 2004243320 | B2 | 3/2010 |
| BE | 745201 | A1 | 7/1970 |
| BE | 783313 | A1 | 11/1972 |
| BG | 62607 | B1 | 3/2000 |
| BR | 8500825 | A | 10/1985 |
| BR | 9007401 | A | 6/1992 |
| BR | 9105879 | A | 11/1992 |
| BR | 9201556 | A | 12/1992 |
| BR | 9206669 | A | 5/1995 |
| BR | 9406119 | A | 12/1995 |
| BR | 9305765 | A | 1/1997 |
| BR | 9607940 | A | 6/1998 |
| BR | 9905736 | A | 9/2000 |
| BR | PI0514215 | A | 6/2008 |
| BR | PI0514822 | A | 6/2008 |
| BR | P10607233 | A2 | 8/2009 |
| CA | 920090 | A1 | 1/1973 |
| CA | 962628 | A1 | 2/1975 |
| CA | 1010821 | A1 | 5/1977 |
| CA | 1113886 | A1 | 12/1981 |
| CA | 1132099 | A1 | 9/1982 |
| CA | 2053898 | A1 | 12/1990 |
| CA | 2071531 | A1 | 2/1992 |
| CA | 1314839 | C | 3/1993 |
| CA | 2128526 | A1 | 7/1993 |

(56) References Cited

FOREIGN PATENT DOCUMENTS

| | | | |
|---|---|---|---|
| CA | 2126870 | A1 | 8/1993 |
| CA | 2107041 | A1 | 8/1994 |
| CA | 2107055 | A | 8/1994 |
| CA | 2151923 | A1 | 8/1994 |
| CA | 2215927 | A1 | 9/1996 |
| CA | 2379574 | A1 | 3/2001 |
| CA | 2354684 | A1 | 2/2002 |
| CA | 2121890 | C | 1/2003 |
| CA | 2392801 | A1 | 1/2003 |
| CA | 2392828 | A1 | 1/2003 |
| CA | 2527007 | A1 | 12/2004 |
| CA | 2565971 | A1 | 6/2006 |
| CA | 2602222 | A1 | 7/2006 |
| CA | 2580467 | A1 | 11/2006 |
| CA | 2379574 | C | 9/2007 |
| CA | 2683991 | A1 | 10/2008 |
| CA | 2354684 | C | 3/2009 |
| CA | 2392801 | C | 12/2009 |
| CA | 2527007 | C | 12/2009 |
| CH | 519422 | A | 2/1972 |
| CH | 640476 | A5 | 1/1984 |
| CH | 669367 | A5 | 3/1989 |
| CH | 698861 | B1 | 9/2009 |
| CN | 1113201 | A | 12/1995 |
| CN | 1117722 | A | 2/1996 |
| CN | 1117723 | A | 2/1996 |
| CN | 1131635 | A | 9/1996 |
| CN | 1040311 | C | 10/1998 |
| CN | 1216965 | A | 5/1999 |
| CN | 1070143 | C | 8/2001 |
| CN | 1080688 CN | | 3/2002 |
| CN | 1367751 | A | 9/2002 |
| CN | 1166533 | C | 9/2004 |
| CN | 1799946 | A | 7/2006 |
| CN | 1816480 | A | 8/2006 |
| CN | 1984821 | A | 6/2007 |
| CN | 101001788 | A | 7/2007 |
| CN | 101044065 | A | 9/2007 |
| CN | 101044066 | A | 9/2007 |
| CN | 101044067 | A | 9/2007 |
| CN | 101142126 | A | 3/2008 |
| CN | 101395064 | A | 3/2009 |
| CN | 101535146 | A | 9/2009 |
| CO | 4410224 | A1 | 1/1997 |
| DE | 1928684 | A1 | 8/1970 |
| DE | 6922518 | U | 10/1970 |
| DE | 2222655 | A1 | 11/1972 |
| DE | 2350973 | A1 | 4/1974 |
| DE | 130913 | B | 5/1975 |
| DE | 2813454 | A1 | 4/1979 |
| DE | 3100956 | C2 | 8/1984 |
| DE | 3420013 | A1 | 12/1984 |
| DE | 2350973 | C2 | 4/1985 |
| DE | 3421820 | A1 | 12/1985 |
| DE | 4314754 | A1 | 11/1994 |
| DE | 4390357 TO | | 6/1995 |
| DE | 69415655 | T2 | 6/1999 |
| DE | 69424149 | T2 | 11/2000 |
| DE | 69630596 | T2 | 9/2004 |
| DE | 60021731 | T2 | 4/2006 |
| DE | 602005004565 | T2 | 1/2009 |
| DK | 135529 | B | 5/1977 |
| DK | 267684 | A | 12/1984 |
| DK | 85885 | A | 9/1985 |
| DK | 161585 | B | 7/1991 |
| DK | 1397296 | T3 | 12/2005 |
| DK | 1789336 | T3 | 1/2009 |
| EA | 200700511 | A1 | 8/2007 |
| EA | 009267 | B1 | 12/2007 |
| EA | 2008/01786 | A1 | 2/2009 |
| EA | 013494 | B1 | 4/2010 |
| EP | 0154611 | A2 | 9/1985 |
| EP | 0156522 | A1 | 10/1985 |
| EP | 0154611 | A3 | 5/1987 |
| EP | 0225394 | A1 | 6/1987 |
| EP | 0156522 | B1 | 1/1988 |
| EP | 0154611 | B1 | 5/1990 |
| EP | 0474772 | A1 | 3/1992 |
| EP | 0497969 | A4 | 3/1992 |
| EP | 0474772 | A4 | 5/1992 |
| EP | 0497969 | A1 | 8/1992 |
| EP | 0502716 | A2 | 9/1992 |
| EP | 0511502 | A2 | 11/1992 |
| EP | 0511502 | A3 | 2/1994 |
| EP | 0608378 | A1 | 8/1994 |
| EP | 0621848 | A1 | 11/1994 |
| EP | 0623522 | A1 | 11/1994 |
| EP | 0621848 | A4 | 5/1995 |
| EP | 0502716 | A3 | 8/1995 |
| EP | 0669261 | A1 | 8/1995 |
| EP | 0682624 | A1 | 11/1995 |
| EP | 0682625 | A1 | 11/1995 |
| EP | 0511502 | B1 | 4/1996 |
| EP | 0608378 | A4 | 9/1997 |
| EP | 0815028 | A1 | 1/1998 |
| EP | 0682625 | B1 | 12/1998 |
| EP | 0608378 | B1 | 12/1999 |
| EP | 0682624 | B1 | 4/2000 |
| EP | 0815028 | A4 | 5/2001 |
| EP | 0502716 | B1 | 7/2001 |
| EP | 1206396 | A1 | 5/2002 |
| EP | 1327588 | A1 | 7/2003 |
| EP | 0815028 | B1 | 11/2003 |
| EP | 1397296 | A1 | 3/2004 |
| EP | 1206396 | B1 | 8/2005 |
| EP | 1397296 | B1 | 9/2005 |
| EP | 1397296 | B8 | 11/2005 |
| EP | 1636103 | A2 | 3/2006 |
| EP | 1659071 | A2 | 5/2006 |
| EP | 1659071 | A3 | 6/2006 |
| EP | 1679267 | A2 | 7/2006 |
| EP | 1679267 | A3 | 7/2006 |
| EP | 1781548 | A1 | 5/2007 |
| EP | 1789336 | A1 | 5/2007 |
| EP | 1799573 | A1 | 6/2007 |
| EP | 1799574 | A1 | 6/2007 |
| EP | 1828000 | A1 | 9/2007 |
| EP | 1799574 | B1 | 1/2008 |
| EP | 1879807 | A2 | 1/2008 |
| EP | 1888424 | A2 | 2/2008 |
| EP | 1789336 | B1 | 8/2008 |
| EP | 1781548 | B1 | 10/2008 |
| EP | 1984261 | A1 | 10/2008 |
| EP | 1985549 | A1 | 10/2008 |
| EP | 1327588 | B1 | 11/2008 |
| EP | 1799573 | B1 | 12/2008 |
| EP | 1828000 | B1 | 1/2009 |
| EP | 1659071 | B1 | 2/2009 |
| EP | 1984261 | B1 | 6/2009 |
| EP | 2065314 | A2 | 6/2009 |
| EP | 2065314 | A3 | 9/2009 |
| EP | 2144700 | A2 | 1/2010 |
| ES | 243498 | U | 9/1979 |
| ES | 255671 | U | 10/1981 |
| ES | 286909 | U | 11/1985 |
| ES | 292865 | U | 6/1986 |
| ES | 296723 | U | 12/1987 |
| ES | 295793 | U | 11/1997 |
| ES | 2127378 | T3 | 4/1999 |
| ES | 2146252 | T3 | 8/2000 |
| ES | 2208734 | T3 | 6/2004 |
| ES | 2246899 | T3 | 3/2006 |
| ES | 2247388 | T3 | 3/2006 |
| ES | 2302235 | T3 | 7/2008 |
| ES | 2313457 | T3 | 3/2009 |
| ES | 2314687 | T3 | 3/2009 |
| ES | 2318091 | T3 | 5/2009 |
| ES | 2319554 | T3 | 5/2009 |
| ES | 2327462 | T3 | 10/2009 |
| FI | 842106 | A | 12/1984 |
| FI | 78655 | B | 5/1989 |
| FI | 78655 | C | 9/1989 |
| FI | 952691 | A | 8/1995 |
| FR | 2041038 | A1 | 1/1971 |

(56) References Cited

FOREIGN PATENT DOCUMENTS

| | | | |
|---|---|---|---|
| FR | 2137739 | A1 | 12/1972 |
| FR | 2318083 | A1 | 2/1977 |
| FR | 2403947 | A1 | 4/1979 |
| FR | 2474450 | A1 | 7/1981 |
| FR | 2546853 | A1 | 12/1984 |
| FR | 2701248 | A1 | 8/1994 |
| FR | 2706426 | A | 12/1994 |
| GB | 1091796 | A | 11/1967 |
| GB | 1238767 | A | 7/1971 |
| GB | 1394363 | A | 5/1975 |
| GB | 1433208 | A | 4/1976 |
| GB | 1595286 | A | 8/1981 |
| GB | 2069470 | A | 8/1981 |
| GB | 2140787 | A | 12/1984 |
| GB | 2383995 | A | 7/2003 |
| GB | 2383995 | B | 12/2005 |
| GC | 0000139 | A | 6/2005 |
| GR | 73515 | A1 | 8/1984 |
| HU | 223327 | B1 | 6/2004 |
| IE | 920680 | A1 | 9/1992 |
| IL | 33746 | A | 4/1973 |
| IL | 39378 | A | 10/1974 |
| IT | 1054208 | B | 11/1981 |
| IT | 1095960 | B | 8/1985 |
| IT | 1173373 | B | 6/1987 |
| IT | 1176222 | B | 8/1987 |
| IT | 1194830 | B | 9/1988 |
| IT | 1247435 | B | 12/1994 |
| JP | 54054550 | U | 4/1979 |
| JP | 56142158 | A | 11/1981 |
| JP | 59221248 | A | 12/1984 |
| JP | 60034346 | | 2/1985 |
| JP | 60217957 | A | 10/1985 |
| JP | 05124669 | A | 5/1993 |
| JP | 05196141 | A | 8/1993 |
| JP | 07237646 | A | 9/1995 |
| JP | 8509188 | T | 10/1996 |
| JP | 8509189 | T | 10/1996 |
| JP | 11502491 | T | 3/1999 |
| JP | 20061932214 | A | 7/2006 |
| KR | 1020070061852 | A | 6/2007 |
| KR | 20070086754 | A | 8/2007 |
| MX | 146402 | A | 6/1982 |
| MX | 9707176 | A | 3/1998 |
| MX | PA02001135 | A | 10/2002 |
| MX | PA05012719 | A | 2/2006 |
| MX | 2007008927 | A | 10/2009 |
| NL | 7001222 | A | 8/1970 |
| NL | 7206295 | A | 11/1972 |
| NL | 171687 | C | 5/1983 |
| NL | 8401679 | A | 1/1985 |
| PL | 173080 | B1 | 1/1998 |
| PL | 174688 | B1 | 8/1998 |
| PL | 180383 | B1 | 1/2001 |
| PT | 1799574 | E | 4/2008 |
| PT | 1789336 | E | 11/2008 |
| RO | 118745 | B | 10/2003 |
| RU | 2094343 | | 10/1997 |
| RU | 2126351 | C1 | 2/1999 |
| RU | 2139230 | C1 | 10/1999 |
| RU | 2007108774 | A | 9/2008 |
| RU | 2007128569 | A | 3/2009 |
| SE | 376746 | B | 6/1975 |
| SE | 8100145 | L | 7/1981 |
| SE | 8303099 | L | 12/1984 |
| SE | 8403493 | L | 2/1985 |
| SE | 444425 | B | 4/1986 |
| SE | 460893 | B | 12/1989 |
| WO | WO 90/14945 | A1 | 12/1990 |
| WO | WO 92/03350 | A1 | 3/1992 |
| WO | WO 92/15496 | A1 | 9/1992 |
| WO | WO 9308092 | A1 | 4/1993 |
| WO | WO 93/12983 | | 7/1993 |
| WO | WO 93/13998 | A1 | 7/1993 |
| WO | WO 93/14001 | A1 | 7/1993 |
| WO | WO 93/15970 | A1 | 8/1993 |
| WO | WO 9314988 | A1 | 8/1993 |
| WO | WO 9418084 | A1 | 8/1994 |
| WO | WO 9418085 | A1 | 8/1994 |
| WO | WO 96/20872 | A2 | 7/1996 |
| WO | WO 9629257 | A1 | 9/1996 |
| WO | WO 96/20872 | A3 | 10/1996 |
| WO | WO 97/33802 | A1 | 9/1997 |
| WO | WO 0115988 | A1 | 3/2001 |
| WO | WO 02/076839 | A2 | 10/2002 |
| WO | WO 02/102678 | A1 | 12/2002 |
| WO | WO 02/076839 | A3 | 1/2003 |
| WO | WO 03/099672 | A1 | 12/2003 |
| WO | WO 2004/106172 | A2 | 12/2004 |
| WO | WO 2004/106172 | A3 | 2/2005 |
| WO | WO 2006/019949 | A1 | 2/2006 |
| WO | WO 2006/024550 | A1 | 3/2006 |
| WO | WO 2006/024656 | A1 | 3/2006 |
| WO | WO 2006/060098 | A1 | 6/2006 |
| WO | WO 2006/097151 | A2 | 9/2006 |
| WO | WO 2006/117024 | A1 | 11/2006 |
| WO | WO 2006/097151 | A3 | 6/2007 |
| WO | WO 2007/085106 | A1 | 8/2007 |
| WO | WO 2007117228 | A2 | 10/2007 |
| WO | WO 2007117228 | A3 | 9/2008 |
| WO | WO 2008/130929 | A2 | 10/2008 |
| WO | WO 2008/130929 | A3 | 12/2009 |
| WO | WO 2010/036416 | A | 4/2010 |
| ZA | 200300238 | A | 8/2003 |

OTHER PUBLICATIONS

Silgan White Cap LLC Brochure, "Plasti-Twist TM Plus—43mm VLD/VMD," 2008.

* cited by examiner

IMPACT RESISTANT CLOSURE

CROSS-REFERENCE TO RELATED PATENT APPLICATION

This application is a continuation of U.S. application Ser. No. 12/788,825, titled "Impact Resistant Closure," filed May 27, 2010, which is incorporated herein by reference in its entirety.

FIELD OF THE INVENTION

The present invention relates generally to the field of closures for containers. The present invention relates specifically to closures configured for impact resistance.

BACKGROUND OF THE INVENTION

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Closures are utilized to seal or close containers for a wide variety of items including food, drink, medicine, cleaning products, etc. For many applications, integrity of the closure and integrity of the seal between the closure and the container must be maintained from the time when the container is filled and sealed until the closure is removed from the container by the end user. A closure may be subject to a variety of impact events (e.g., dropping, impact with processing machinery, impact with adjacent containers and/or shipping materials, etc.) that may causes a closure to crack or to release from the container. Such a breach in the integrity of the closure or the seal created by the closure may result in contamination, spoilage or spillage of the contents of the container.

SUMMARY OF THE INVENTION

One embodiment of the invention relates to a closure that includes a top panel and a transition section extending from a peripheral edge of the top panel. The closure includes a skirt extending from a peripheral edge of the transition section such that the skirt extends away from the top panel and a plurality of projections extending outwardly and away from an outer surface of the transition section.

Another embodiment of the invention relates to an impact resistant closure that includes a generally circular top wall and a frustoconical transition section extending from a peripheral edge of the top wall. The closure includes a generally cylindrical skirt extending from a peripheral edge of the transition section such that the skirt is substantially perpendicular to the top wall and a plurality of evenly spaced projections extending outwardly and away from an outer surface of the transition section. The plurality of projections configured to absorb impact energy to resist failure of the closure.

Another embodiment of the invention relates to a closure configured to be coupled to a container. The closure includes a top wall and a frustoconical transition section extending downwardly and outwardly from an outer edge of the top wall. The closure includes a generally cylindrical skirt extending from an outer edge of the transition section such that the skirt is substantially perpendicular to the top wall. The skirt includes an upper section and a lower section, and the radius of the lower section is greater than the radius of the upper section. The closure includes at least one thread extending from an inner surface of the upper section of the skirt configured for engagement with threading located on a neck portion of the container and a plurality of projections extending outwardly and away from an outer surface of the transition section. The closure includes a plurality of raised ribs extending outwardly from the outer surface of the upper section of the skirt and extending axially along the length of the upper section of the skirt and a tamper evident band including a frangible connecting element coupling the tamper evident band to the lower section of the skirt.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
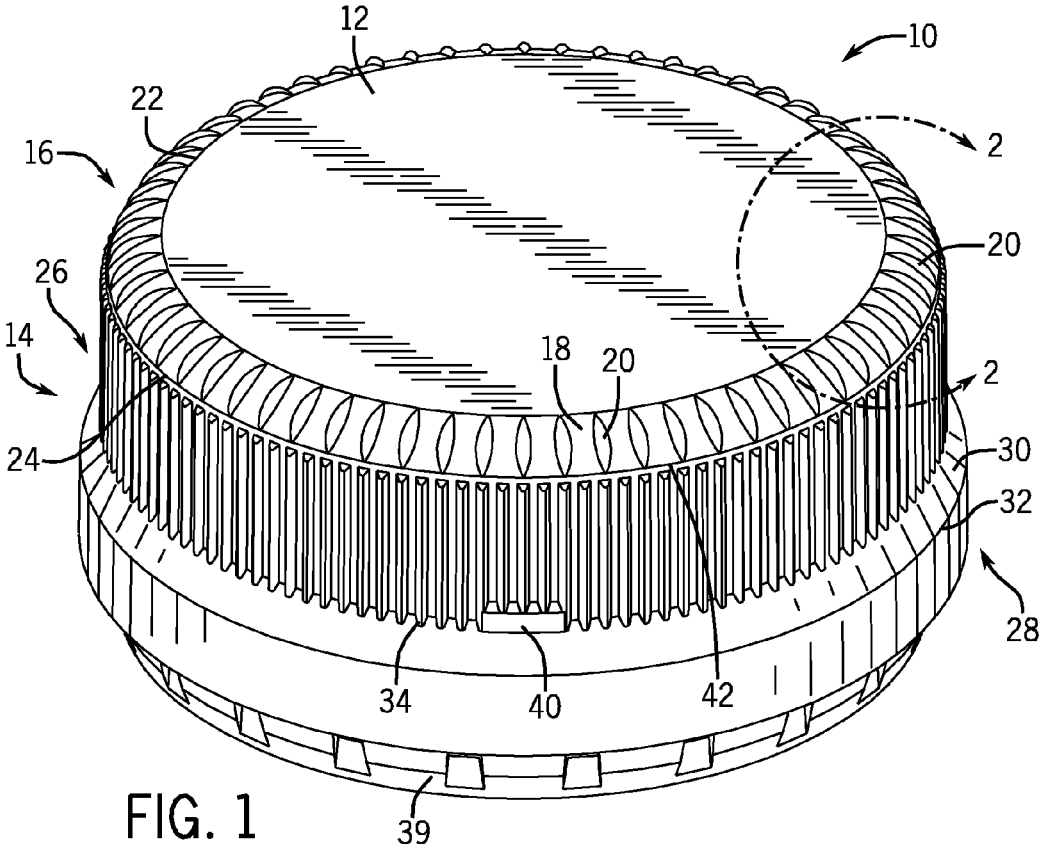
FIG. 1 is a perspective view of a closure according to an exemplary embodiment.

Referring to FIG. 1, a closure 10 is depicted according to an exemplary embodiment. The closure 10 includes a top panel or top portion, shown as a top wall 12. As shown, top wall 12 is generally circular and is generally planar (i.e., the outer surface of top wall 12 is flat lying substantially in a single plane, shown as a generally horizontal plane in FIG. 1). Closure 10 includes a skirt 14 and a transition section, shown as a corner section 16. Corner section 16 extends outwardly and downwardly from the outer or peripheral edge 22 of top wall 12, and skirt 14 extends downwardly from the peripheral edge 24 of corner section 16. As shown in FIG. 1, skirt 14 is generally circular in cross-section and is substantially perpendicular to the plane defined by top wall 12.

In the exemplary embodiment shown in FIG. 1, the outer surface 18 of corner section 16 is a frustoconical shaped surface. Closure 10 includes a series of projections, shown as bumpers 20, extending outwardly and away from outer surface 18 of corner section 16. In the embodiment shown in FIG. 1, bumpers 20 are continuous raised structures extending between peripheral edge 22 of top wall 12 and the peripheral edge 24 of corner section 16. Bumpers 20 are positioned on corner section 16 to provide improved impact resistance by absorbing energy that may be imparted to closure 10 by contact with an object (e.g., another container or equipment during processing or shipment) or with a surface, such as the ground or floor, if the container having closure 10 drops or falls. In one embodiment, bumpers 20 may be configured to deform or crumple upon impact to absorb impact energy, thereby preventing or resisting damage to closure 10 that may otherwise be caused by the impact.

Skirt 14 includes an upper section or portion 26, a lower section or portion 28, and an angled section or portion 30 positioned between upper portion 26 and lower portion 28. As shown, angled section 30 is a frustoconical section extending downwardly and outwardly from the lower edge of upper section 26, and lower portion 28 extends downwardly from the peripheral or outer edge 32 of angled section 30 substantially perpendicular to the plane defined by top wall 12. As shown in FIG. 1, the radius of lower section 28 is greater than the radius of either top wall 12 or upper portion 26 of skirt 14.

In the embodiment shown in FIG. 1, upper section 26 of skirt 14 includes a plurality of raised ribs 34 extending outwardly from the outer surface of upper section 26. As shown in FIG. 1, the majority of ribs 34 extend axially along substantially the entire height of upper section 26. The lower ends of ribs 34 are angled to match the angle of angled section 30. Upper section 26 of skirt 14 includes a sidewall section 42 located above the upper ends of ribs 34 and extending to peripheral edge 24 of corner section 16. In this arrangement, sidewall section 42 provides a gap or space between bumpers 20 and ribs 34 such that bumpers 20 and ribs 34 do not form a single continuous raised structure. Ribs 34 are spaced and sized to provide improved grip during twist-on/twist-off of closure 10.

In FIG. 1, closure 10 is shown as the closure appears following removal from the mold. Closure 10 includes a J-flap band 39 extending from the lower portion 28 of skirt 14. J-flap band 39 is shown in FIG. 1 in an unfolded configuration. As explained below regarding FIG. 4B, J-flap band 39 engages a bead on the neck of the container to facilitate separation of a tamper evident structure during twist off of closure 10.

As shown in FIG. 1, the closure 10 includes a locating feature 40. Locating feature 40 extends from the outer surface of upper portion 26 of skirt 14. Locating feature 40 provides for alignment of closure 10 as may be needed during various processes (e.g., handling, filling of the container, capping, shipping, etc.). For example, locating feature 40 provides for proper alignment of closure 10 relative to the container during the capping stage of the filing process. As shown in FIG. 1, the ribs 34 that are positioned directly above locating feature 40 extend to the upper edge of locating feature 40 instead of extending to angled section 30.

Figure 2:
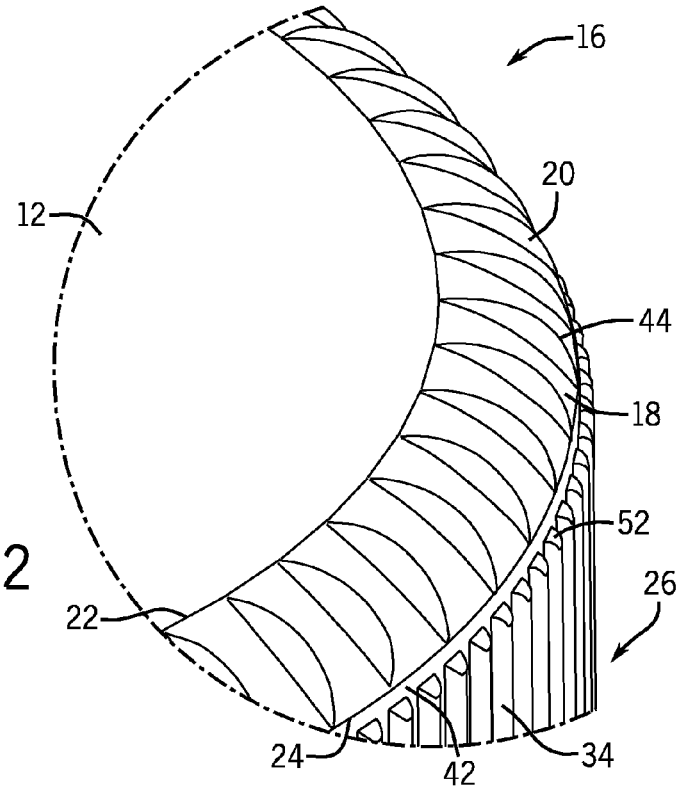
FIG. 2 is an enlarged perspective view of the transition section of the closure of FIG. 1, using lines 2-2 of FIG. 1 as a boundary.

Referring to FIG. 2, an enlarged perspective view of corner section 16 of closure 10 is shown. As shown in FIG. 2, corner section 16 includes a flat, generally frustoconical surface 18 extending downwardly and outwardly from peripheral edge 22 of top wall 12. In the embodiment shown, bumpers 20 include an outer surface 44 that extends between peripheral edge 22 of top wall 12 and the lower, outer peripheral edge 24 of corner section 16.

FIG. 2 shows sidewall section 42 of upper section 26 of skirt 14. As shown, sidewall section 42 is positioned generally above upper ends 52 of raised ribs 34 and below peripheral edge 24 of corner section 16. As shown in FIGS. 1 and 2, sidewall section 42 forms a complete unbroken loop around the entire perimeter of skirt 14, and sidewall section 42 is recessed relative to raised ribs 34 such that bumpers 20 and ribs 34 do not form a continuous raised structure extending from the outer surface of closure 10.

Figure 3:
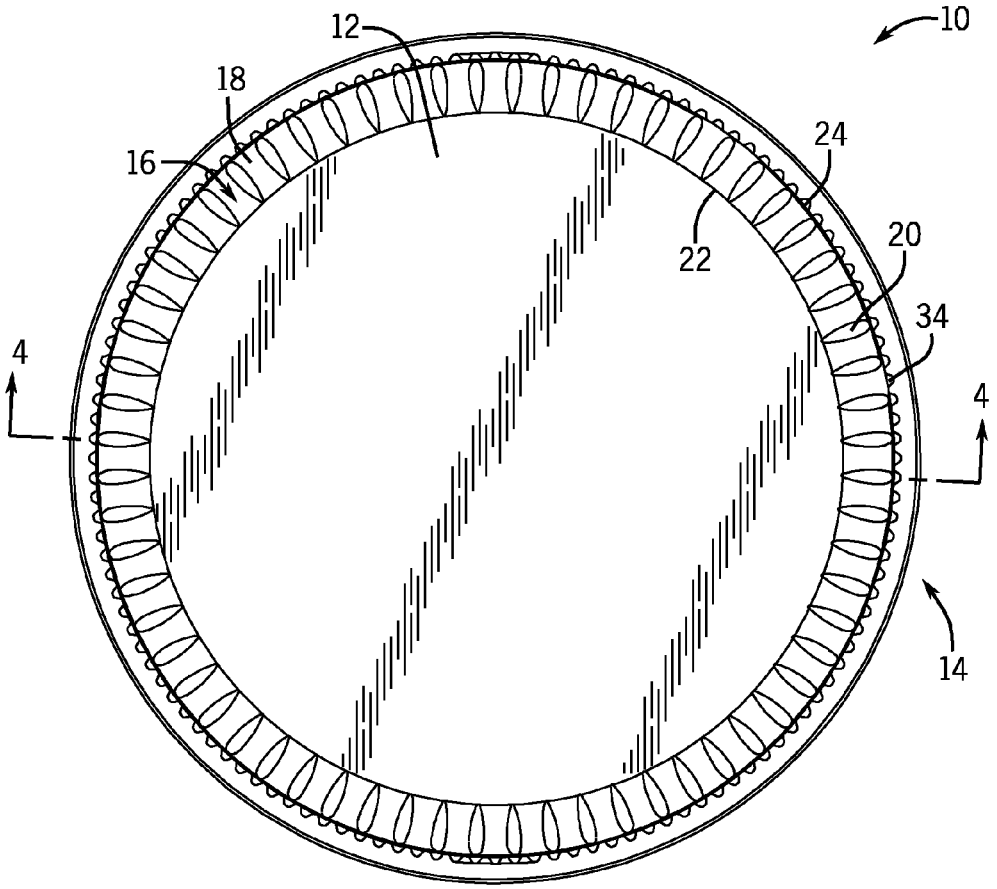
FIG. 3 is a top view of the closure of FIG. 1.

FIG. 3 is a top view of closure 10. As shown in FIG. 3, bumpers 20 are evenly spaced along corner section 16 (i.e., the spacing between each pair of bumpers 20 is same). Raised ribs 34 are also evenly spaced along the outer section of upper section 26 of skirt 14. In the embodiment shown, the number of bumpers 20 and of ribs 34 are such that closure 10 is essentially radially symmetric (except for the threading and locating feature 40). As shown in the embodiment of FIG. 3, every other bumper 20 is aligned with a raised rib 34 such that a radial line extending through the radial centerline of every other bumper 20 also extends through the radial centerline of the aligned raised rib 34. Thus, in this embodiment, closure 10 includes twice the number of raised ribs 34 as bumpers 20. Further, in the embodiment of FIG. 3, the number of bumpers 20 is 64 and the number of ribs is 128.

Figure 4A:
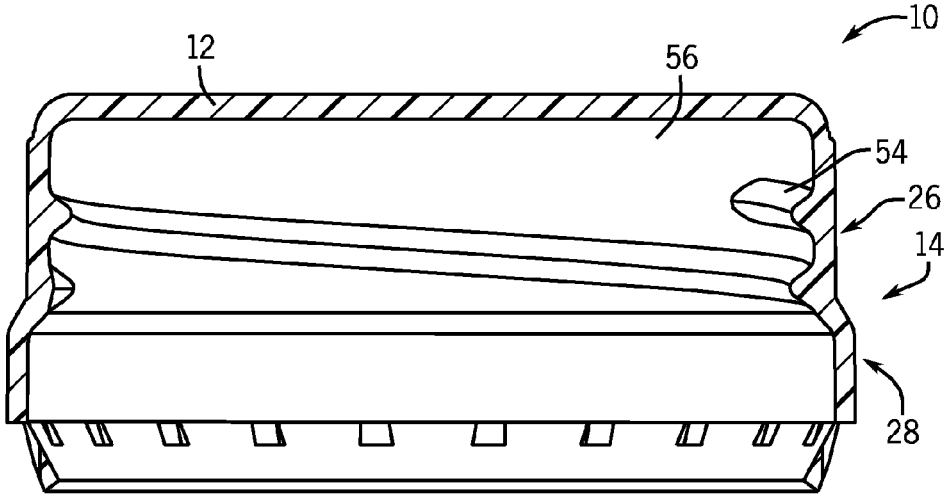
FIG. 4A is a side sectional view showing the interior of the closure of FIG. 1, taken along lines 4-4 of FIG. 3.

FIG. 4A is a side sectional view taken along line 4-4 shown in FIG. 3. As shown in FIG. 4A, closure 10 includes a container engagement structure, shown as threading 54. Threading 54 extends inwardly from the inner surface 56 of upper portion 26 of skirt 14. Threading 54 is configured to engage corresponding threading present on the container to which closure 10 is attached. In various other embodiments, closure 10 may include other engagement structures, such as snap beads, or closure 10 may be coupled to the container via other mechanisms, such as by ultrasonic welding.

Figure 4B:
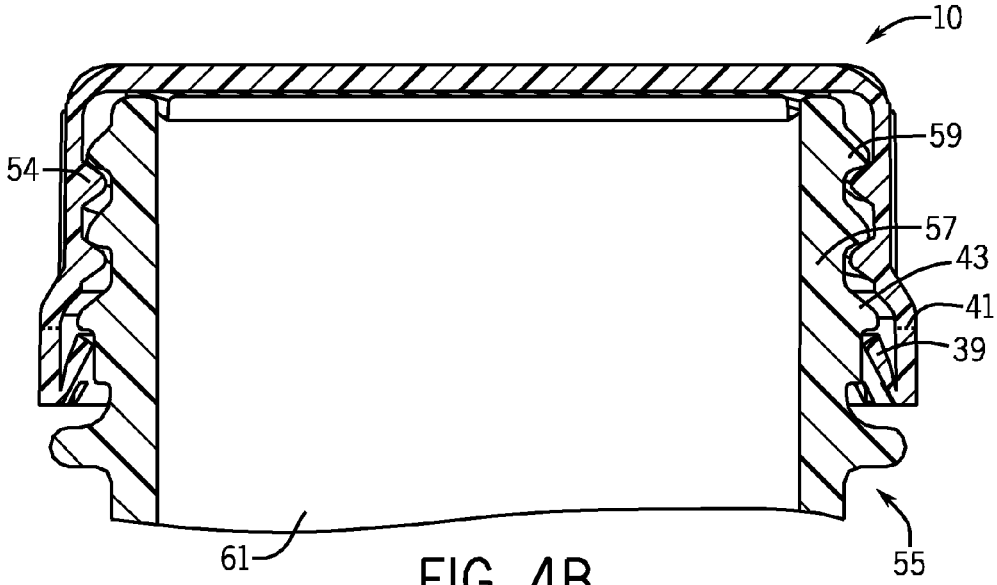
FIG. 4B is a side section view showing the closure of FIG. 1 attached to a container, according to an exemplary embodiment.

As shown in FIG. 4B, closure 10 may be coupled to a container 55. In this embodiment, container 55 includes a neck portion 57 that is open at the top end. Neck portion 57 of container 55 includes threading 59. Closure 10 is coupled to neck portion 57 via engagement between threading 54 of closure 10 and threading 59 of container 55 to seal or close neck portion 57. While not shown in FIG. 4B, container 55 also includes a body side wall and an end wall at the lower end of the body side wall such that container 55 is capable of holding material within an interior chamber 61 of container 55. Container 55 may be any container that is sealed by a closure, such as closure 10, and container 55 may be suitable for holding a variety of contents including food, drink, etc., within chamber 61.

As shown in FIG. 4B, lower portion 28 of skirt 14 may be configured to function as a tamper evidencing structure. In this embodiment, lower portion 28 may include a weakened section 41. In one embodiment, weakened section 41 is a slit line formed by a slitter machine. In FIG. 4B, J-flap band 39 is shown in the folded configuration engaging a bead 43. Upon application of twisting force to closure 10, weakened section 41 is configured to break, separating the portion of skirt 14 below weakened section 41 from the portion of closure 10 above weakened section 41. This separation provides a visual indication to the user of whether closure 10 has previously been removed from the container to which it is attached. Thus, in this embodiment, the section of lower portion 28 below weakened section 41 acts as a tamper evident band and weakened section 41 acts as a frangible connecting element. Further, in this embodiment, the engagement between J-flap band 39 and bead 43 facilitates breaking of weakened section 41 during twist-off of the closure.

Figure 5:
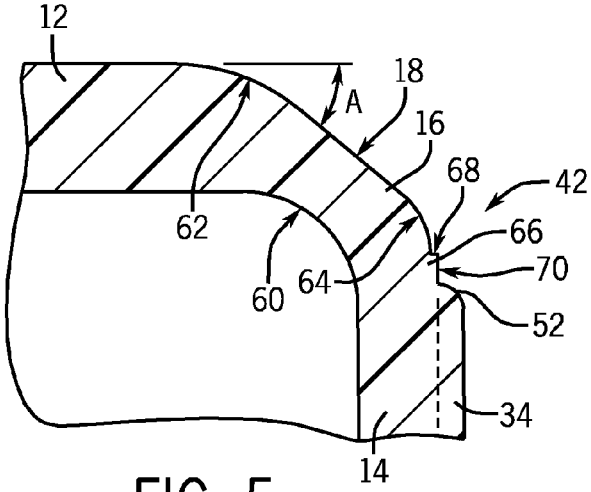
FIG. 5 is an enlarged side sectional view showing the transition section of the closure of FIG. 1, taken along lines 5-5 of FIG. 7.
Figure 7:
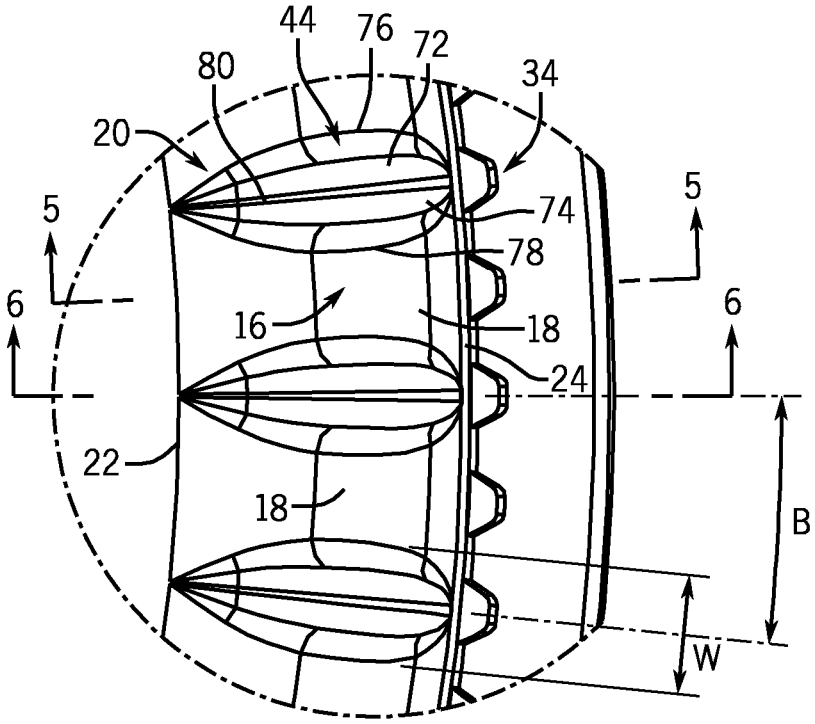
FIG. 7 is an enlarged top view showing a portion of the transition section and impact resistant projections of the closure of FIG. 1.

FIG. 5 is an enlarged side sectional view showing corner section 16 taken along line 5-5 shown in FIG. 7. As shown in FIG. 5, corner section 16 includes an angled outer surface 18 that defines the generally frustoconical shape of corner section 16. In various embodiments, the angle A between outer surface 18 and the horizontal plane generally defined by top wall 12 may be selected to vary the impact resistant characteristics of bumpers 20 extending from outer surface 18. In various exemplary embodiments, the angle A between outer surface 18 and the horizontal plane generally defined by top wall 12 is between about 60 degrees and about 20 degrees. In particular embodiments, the angle A is between about 50 degrees and about 30 degrees, and more particularly between about 45 degrees and about 35 degrees. In the exemplary embodiment shown in FIG. 5, the angle between outer surface 18 and the horizontal plane generally defined by top wall 12 is about 40 degrees.

As shown in FIG. 5, the inner surface 60 of corner section 16 between the inner surfaces of top wall 12 and skirt 14 is a curved fillet section. In addition, corner section 16 includes a convex round segment 62 joining the outer surface of top wall 12 to outer surface 18 of corner section 16. FIG. 5 shows sidewall section 42 located above the upper end 52 of rib 34 and below corner section 16. Corner section 16 includes a convex round segment 64 joining the outer surface of skirt 14 to the outer surface 18 of corner section 16. In the embodiment shown, sidewall section 42 includes a raised circumferential bead 66. Bead 66 includes a generally upwardly facing horizontal surface 68 and a generally outwardly facing vertical surface 70. As shown, bead 66 extends axially a portion of the distance from upper end 52 of rib 34 toward corner section 16, and the radius of bead 66 at vertical surface 70 is less than the radius of the outer surface of rib 34 and is greater than the radius of sidewall section 42 immediately above bead 66.

Figure 6:
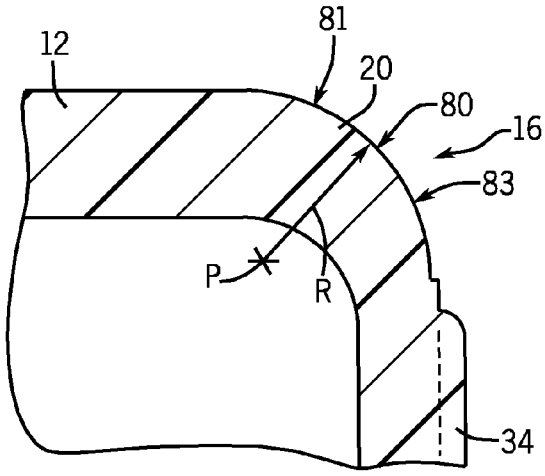
FIG. 6 is an enlarged side sectional view showing an impact resistant projection extending outwardly from the outer surface of the transition section of the closure of FIG. 1, taken along lines 6-6 of FIG. 7.

FIG. 6 is an enlarged side sectional view taken along line 6-6 in FIG. 7 showing corner section 16 and bumper 20. FIG. 6 is a sectional view taken along a radial centerline that passes through both the center of one of the bumpers 20 and one of the ribs 34. As shown in FIG. 6, outer surface 44 of bumper 20 includes a continuous curved segment 80. Continuous curved segment 80 is the outer-most segment of bumper 20 that lies in the radial plane shown in FIG. 6 and defines the height of bumper 20 relative to the outer surface 18 of corner section 16. As shown in FIG. 6, the inner segment 81 of continuous curved segment 80 smoothly transitions into the surface of top wall 12 (i.e., the inner most segment of continuous curved segment 80 lies in the same plane as the outer surface of top wall 12). The outer segment 83 of continuous curved segment 80 smoothly transitions into the surface of skirt 14 (i.e., the outer most segment of continuous curved segment 80 lies in the cylindrical surface defined by the outer surface of upper section 26 of skirt 14).

In various embodiments, the radius of curvature R defining continuous curved segment 80 of bumper 20 may be selected to vary the impact resistant characteristics of bumpers 20 extending from outer surface 18. In one exemplary embodiment, closure 10 is a 38 mm closure, meaning that closure 10 is sized to fit a container neck finish having an outer thread diameter (i.e., the diameter of the container neck measured between the outer edges of the threading) of about 38 mm. In this embodiment, R is about 0.075 inches from a center point P located on a concentric diameter line of about 1.384 inches.

As shown in FIG. 7, both bumpers 20 and ribs 34 are symmetric about the radial centerlines. In various embodiments, the angle B between radial centerlines of adjacent bumpers 20 may be selected to vary the impact resistant characteristics of bumpers 20 extending from outer surface 18. In various exemplary embodiments, the angle B between radial centerlines of adjacent bumpers 20 is between about 2 degrees and about 8 degrees. In particular embodiments, the angle B is between about 3 degrees and about 7 degrees, and more particularly between about 4 degrees and about 6 degrees. In the exemplary embodiment shown in FIG. 7, the angle B between radial centerlines of adjacent bumpers 20 is between about 5 and about 6 degrees and more specifically is about 5.625 degrees.

Figure 8:
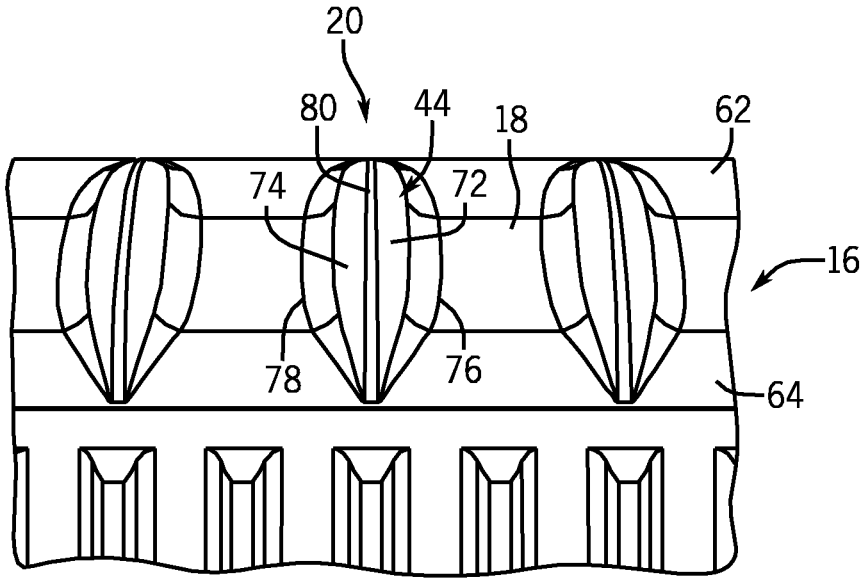
FIG. 8 is an enlarged side view showing a portion of the transition section and impact resistant projections of the closure of FIG. 1.

Referring to FIG. 7 and FIG. 8, continuous curved segment 80 of outer surface 44 of bumper 20 extends from peripheral edge 22 of top wall 12 to peripheral edge 24 of corner section 16. Each bumper 20 includes a first sidewall portion 72 that extends from one side or edge (e.g., the upper edge in the orientation of FIG. 7 and the right edge in the orientation of FIG. 8) of segment 80 down to outer surface 18 of corner section 16. First sidewall portion 72 includes an first edge 76 at the position where sidewall 72 meets outer surface 18. Each bumper 20 includes a second sidewall portion 74 that extends from the other side or edge (e.g., the lower edge in the orientation of FIG. 7 and the left edge in the orientation of FIG. 8) of segment 80 down to outer surface 18 of corner section 16. Second sidewall portion 74 includes an second edge 78 at the position where sidewall 74 meets outer surface 18. In the embodiment shown in FIGS. 7 and 8, first edge 76 and second edge 78 are both outwardly curved relative to the radial centerline of bumper 20.

As shown in FIGS. 7 and 8, sidewall portions 72 and 74 are inwardly curved relative to the radial center line of bumpers 20. In other embodiments, sidewall portions 72 and 74 may be planar sidewalls at an angle to or perpendicular to outer surface 18 of corner section 16. In yet other embodiments, sidewall portions 72 and 74 may be outwardly curved relative to the radial centerline of the bumper. The width W of the base of bumper 20 is defined as the distance between edges 76 and 78 along a line perpendicular to the radial centerline of bumper 20 in the plane of outer surface 18 of corner section 16. As shown, width W decreases from the maximum width as bumper 20 extends towards peripheral edge 22 of top wall 12 and also decreases from a maximum width as bumper 20 extends towards peripheral edge 24 of corner section 16. Thus, the inner and outer ends of edges 76 and 78 converge at peripheral edge 22 of top wall 12 as bumper 20 transitions into top wall 12 and at peripheral edge 24 of corner section 16 as bumper 20 transitions into skirt 14, respectively.

Figure 9:
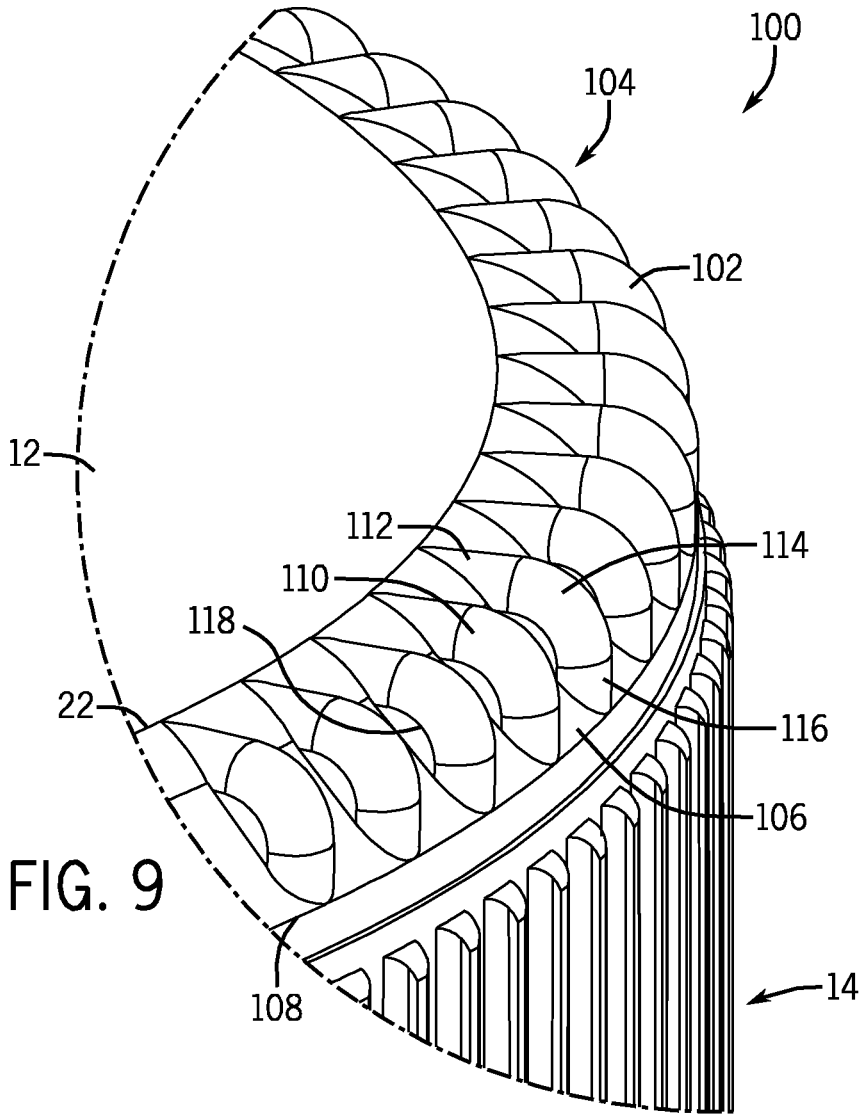
FIG. 9 is an enlarged perspective view of the transition section of a closure according to another exemplary embodiment.

Referring to FIGS. 9-13, closure 100 is shown according to a second exemplary embodiment. Closure 100 is essentially the same as described above regarding FIGS. 1-8, however, closure 100 includes another exemplary embodiment of impact resistant features. As shown in FIG. 9, closure 100 includes a series of projections, shown as bumpers 102, extending outwardly and away from outer surface 106 of corner section 104. Corner section 104 includes a flat, generally frustoconical outer surface 106 extending downwardly and outwardly from peripheral edge 22 of top wall 12. Like bumpers 20, bumpers 102 are continuous raised structures extending between peripheral edge 22 of top wall 12 and the peripheral edge 108 of corner section 104 and provide impact resistance to prevent or resist failure of closure 100 upon impact.

In the embodiment shown, bumpers 102 each include a radial section 112, a rounded corner section 114, and a axial section 116. The outer surfaces of segments 112, 114 and 116 define a rounded outer surface 110 of each bumper 102. As shown in FIG. 9, outer surface 110 is rounded in the circumferential direction. Rounded corner section 114 joins radial section 112 and axial section 116.

Figure 10:
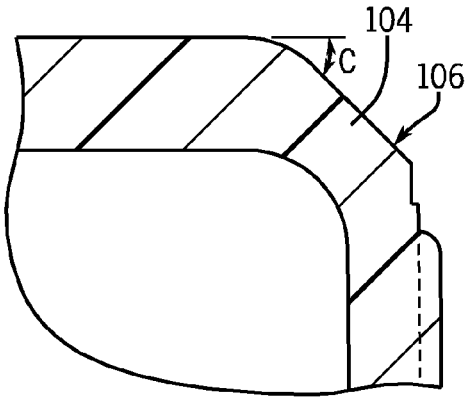
FIG. 10 is an enlarged side sectional view showing the transition section of the closure of FIG. 9, taken along lines 10-10 of FIG. 12.
Figure 12:
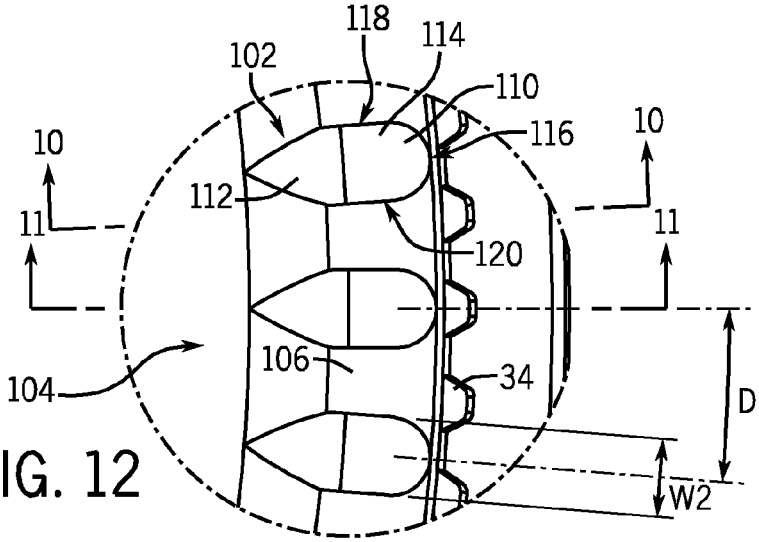
FIG. 12 is an enlarged top view showing a portion of the transition section and impact resistant projections of the closure of FIG. 9.

FIG. 10 is an enlarged side sectional view showing corner section 104 taken along line 10-10 shown in FIG. 12. As shown in FIG. 10, corner section 104 includes an angled outer surface 106 that defines the generally frustoconical shape of corner section 104. In various exemplary embodiments, the angle C between outer surface 106 and the horizontal plane generally defined by top wall 12 is between about 60 degrees and about 20 degrees. In particular embodiments, the angle C is between about 50 degrees and about 30 degrees, and more particularly between about 50 degrees and about 40 degrees. In the exemplary embodiment shown in FIG. 10, the angle C between outer surface 106 and the horizontal plane generally defined by top wall 12 is about 45 degrees.

Figure 11:
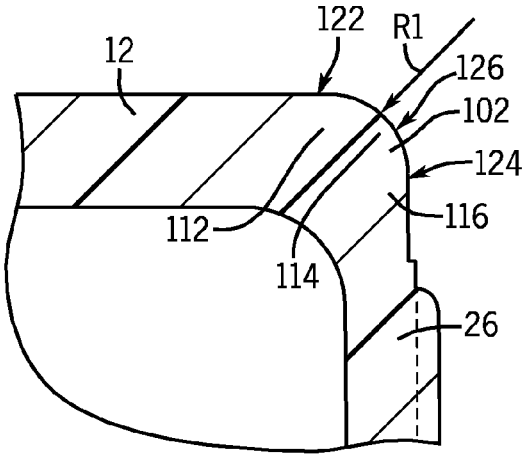
FIG. 11 is an enlarged side sectional view showing an impact resistant projection extending outwardly from the outer surface of the transition section of the closure of FIG. 9, taken along lines 11-11 of FIG. 12.

FIG. 11 is an enlarged side sectional view taken along line 11-11 in FIG. 12 showing corner section 104 and bumper 102. FIG. 11 is a sectional view taken along a radial centerline that passes through both the center of one of the bumpers 102 and one of the ribs 34. As shown in FIG. 11, the outer most segment 122 of radial section 112 lies in the same plane as the outer surface of top wall 12 such that radial section 112 smoothly transitions into top wall 12. In addition, the outer most segment 124 of axial section 116 lies in the cylindrical surface defined by the outer surface of upper section 26 of skirt 14 such that axial section 116 smoothly transitions into skirt 14. The outer most segment 126 of rounded corner section 114 joins outer most segment 122 and outer most segment 126. As shown in FIG. 11, the outer most segments 122, 124 and 126 are the outer-most segments of bumper 102 that lie in the radial plane shown in FIG. 11, and they define the maximum height of bumpers 102 relative to outer surface 106 of corner section 104. In various embodiments, the radius of curvature R1 defining the curve of rounded corner section 114 of bumper 102 may be selected to vary the impact resistant characteristics of bumpers 102 extending from outer surface 106. In one exemplary embodiment, R1 is about 0.035 inches.

As shown in FIG. 12, bumpers 102 are symmetric about the radial centerlines. In various embodiments, the angle between radial centerlines of adjacent bumpers 102 may be selected to vary the impact resistant characteristics of bumpers 102 extending from outer surface 106. In various exemplary embodiments, the angle D between radial centerlines of adjacent bumpers 20 is between about 2 degrees and about 8 degrees. In particular embodiments, the angle D is between about 3 degrees and about 6 degrees, and more particularly between about 4 degrees and about 5 degrees. In the exemplary embodiment shown in FIG. 12, the angle D between radial centerlines of adjacent bumpers 102 is between about 4.25 and about 4.75 degrees and more specifically is about 4.5 degrees. In this embodiment, closure 100 includes 80 bumpers 102 spaced evenly along corner section 104.

Figure 13:
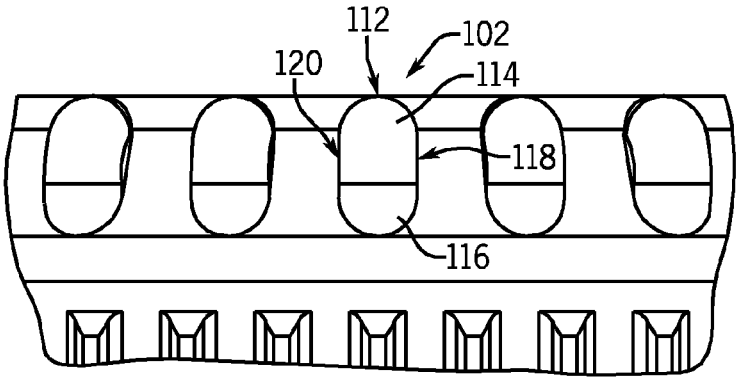
FIG. 13 is an enlarged side view showing a portion of the transition section and impact resistant projections of the closure of FIG. 9.

Referring to FIG. 12 and FIG. 13, radial section 112 extends radially along the radial centerline of each bumper 102 and axial section 116 is perpendicular to the radial centerline of each bumper and extends in the axial direction. Bumpers 102 include a first sidewall 118 that extends from one side or edge (e.g., the upper edge in the orientation of FIG. 12 and the right edge in the orientation of FIG. 13) of rounded outer surface 110 down to outer surface 106 of corner section 104. Bumpers 102 include a second sidewall 120 that extends from the other side or edge (e.g., the lower edge in the orientation of FIG. 12 and the left edge in the orientation of FIG. 13) of rounded outer surface 110 down to outer surface 106 of corner section 104. As shown in FIGS. 12 and 13, sidewalls 118 and 120 are planar sidewalls perpendicular to outer surface 106 of corner section 104. However, in other embodiments, sidewalls 118 and 120 may be planar walls at other angles relative to outer surface 106 of corner section 104. In yet other embodiments, sidewalls 118 and 120 may be either outwardly or inwardly curved relative to the radial centerline of the bumper.

The width of bumper 102, W2, is the distance between sidewalls 118 and 120 in a direction perpendicular to the radial centerline of bumper 102. In various exemplary embodiments, W2 of bumper 102 may be between about 0.02 inches and about 0.04 inches. In particular embodiments, W2 is between about 0.025 inches and about 0.035 inches, and more particularly between about 0.030 and about 0.032 inches. In the embodiment shown, W2 is about 0.031 inches.

Figure 14:
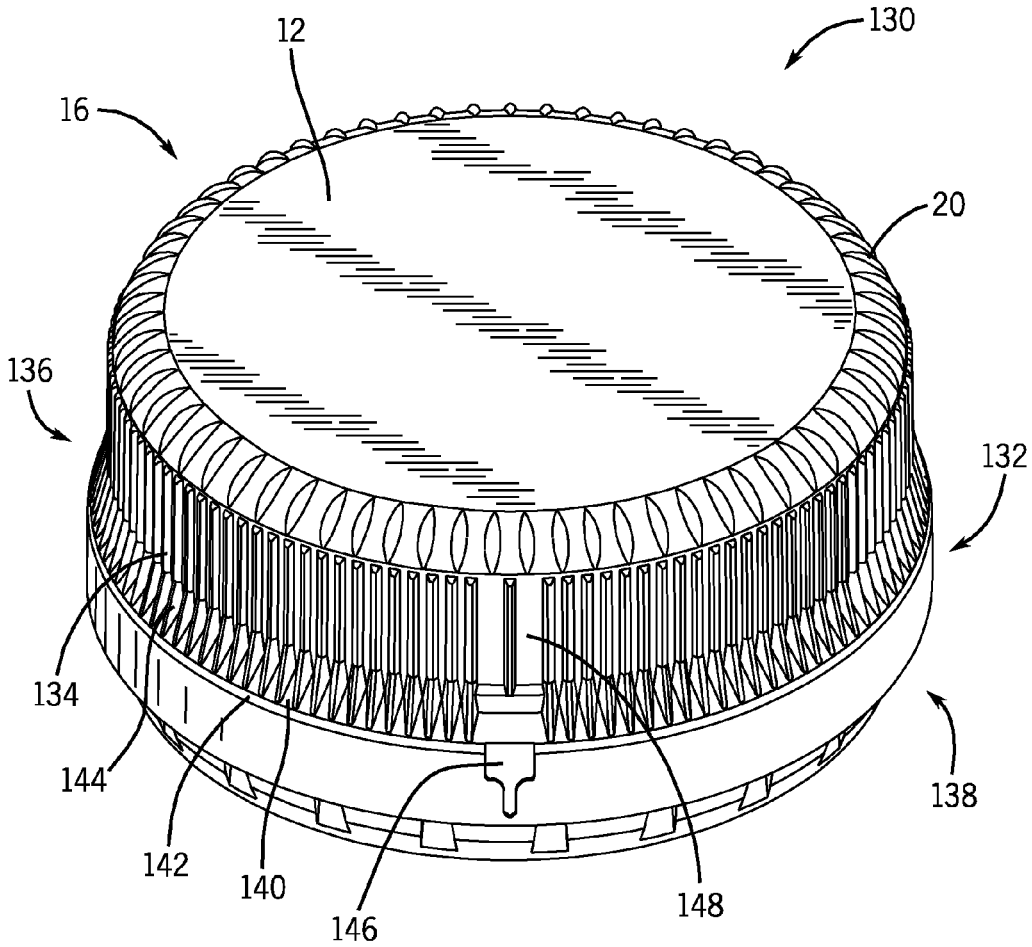
FIG. 14 is a perspective view of a closure according to another exemplary embodiment.

Referring to FIG. 14, closure 130 is shown according to another exemplary embodiment. Closure 130 includes a skirt 132 and raised ribs 134. Like closure 10, closure 130 includes bumpers 20 extending from corner section 16. Skirt 132 extends from the peripheral edge of corner section 16. Skirt 132 includes an upper section or portion 136, a lower section or portion 138, and an angled section or portion 140 positioned between upper portion 136 and lower portion 138. As shown, angled section 140 is a frustoconical section extending downwardly and outwardly from the lower edge of upper section 136. Lower portion 138 extends downwardly from the peripheral or outer edge 142 of angled section 140 substantially perpendicular to the plane defined by top wall 12. The radius of lower section 138 is greater than the radius of either top wall 12 or upper portion 136 of skirt 132.

Referring to FIG. 14, closure 130 includes raised ribs 134 that extend outwardly from the outer surface of upper section 136 and that extend axially along substantially the entire height of upper section 136. Each rib 134 includes a lower, flared section 144 that extends radially outward and is angled to match the angle of angled section 140. As shown in FIG. 14, flared section 144 of each rib 134 is shaped such that the radius of ribs 134 at their outer edges continuously increase along the axial length of the flared section 144. In one embodiment, closure 130 is made by an injection molding process. In this embodiment, flared sections 144 strengthen or support skirt 132 during axial loading of the closure that may occur during removal or ejection from the injection mold. Further, as shown in FIG. 14, closure 130 includes a pull-up mark 146 and a sidewall section 148, above pull-up mark 146, that does not include ribs 134. In the embodiment shown, two ribs 134 are missing above pull-up mark 146. Pull-up mark 146 acts as a visible feature, allowing for evaluation and inspection of closure-to-container thread interaction.

In various embodiments, the closures discussed herein may be formed from a plastic or polymer material. In various embodiments, the closures may be formed by injection molding or by compression molding. For example, the closures may be compression molded from polypropylene homopolymer resin. Alternatively, the closures may be made from a clear (e.g., translucent or transparent) polypropylene homopolymer resin, or they may be made from a clear random copolymer polypropylene. In various embodiments, the clear material of the closure is such that the engagement structure (e.g., threading 54) is visible from the outside of the closure through the skirt of the closure. Impact resistant features, such as bumpers 20, may allow for the closures to be made using less material (e.g., the closure with bumpers 20 may have thinner sidewalls and may weigh less) than a closure without bumpers while still providing acceptable impact resistant properties. Further, impact resistant features, such as bumpers 20, may allow for the closures to be made from a material that has inherently lower impact resistant qualities than some other materials (e.g., impact resistant copolymers, etc.) while still providing acceptable impact resistant properties.

In various embodiments, the closures discussed herein may be of various sizes intended to seal containers of various sizes and having various contents. In some exemplary embodiments, the closures are configured to seal containers such as metal, glass or plastic containers or bottles for holding liquids. In specific embodiments, the closures may be 38 mm closures. In various embodiments, the bumpers described herein, including bumpers having the specific shapes, sizes, positioning, etc. of bumpers 20 and bumpers 102 described herein, have been found to provide increased impact resistance when compared to some closures without such bumpers or to some bumpers having other shapes, sizes, positioning, etc.

Further modifications and alternative embodiments of various aspects of the invention will be apparent to those skilled in the art in view of this description. Accordingly, this description is to be construed as illustrative only. The construction and arrangements of the closures, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

What is claimed is:

1. A closure comprising:

a top wall;

a top wall peripheral edge defining the outer perimeter of the top wall;

a transition section extending radially outward and downward from the top wall peripheral edge;

a transition section peripheral edge defining the outer perimeter of the transition section;

a cylindrical sidewall extending downward from the transition section peripheral edge; and a plurality of raised projections extending outwardly away from an outer surface of the transition section, wherein each entire raised projection is located between the top wall peripheral edge and the transition section peripheral edge;

wherein a radially innermost segment of each of the plurality of raised projections is coplanar with the top wall and a radially outermost segment of each of the plurality of raised projections lies within the cylindrical surface defined by the outer surface of the cylindrical sidewall.

2. The closure of claim 1 further comprising a plurality of raised ribs extending outwardly from an outer surface of the cylindrical sidewall and extending axially along at least a portion of the cylindrical sidewall.

3. The closure of claim 2 wherein the plurality of raised projections all have the same shape and the outer surfaces of the plurality of raised projections do not extend radially beyond the outer surface of the cylindrical sidewall.

4. The closure of claim 2 wherein the cylindrical sidewall comprises a sidewall section located below the transition section peripheral edge and above an upper end of each of the raised ribs, wherein the outer radius of the sidewall section is less than the radius of the outermost surfaces of the plurality of raised ribs.

5. The closure of claim 2 wherein the number of the raised projections is less than the number of the raised ribs.

6. The closure of claim 5 wherein the plurality of projections are evenly spaced from each other along the transition section.

7. The closure of claim 1 wherein the cylindrical sidewall is substantially perpendicular to the top wall and the outer surface of the transition section is generally frustoconical.

8. The closure of claim 1 wherein the angle between a plane defined by the top wall and a frustoconical portion of the outer surface of the transition section is between about 20 degrees and about 60 degrees.

9. The closure of claim 1 wherein an outer surface of each of the plurality of projections includes a continuous curved segment extending radially between the top wall peripheral edge and the transition section peripheral edge such that the outermost radius of each of the plurality of projections is less than the outermost radius of the cylindrical sidewall.

10. The closure of claim 1 wherein the plurality of raised projections are configured deform upon impact to absorb impact energy.

11. A closure comprising:

a planar top wall;

a transition section extending radially outward and downward from a peripheral edge of the top wall;

a cylindrical skirt extending downward from a peripheral edge of the transition section; and a plurality of raised projections extending outwardly away from an outer surface of the transition section, wherein a radially, innermost segment of each of the raised projections is coplanar with the top wall and a lower, outermost segment of each of the raised projections lies in a cylindrical surface defined by an outer surface of the cylindrical skirt.

12. The closure of claim 11 wherein an outer surface of each of the plurality of projections includes a continuous curved segment extending from the peripheral edge of the top wall to the peripheral edge of the transition section.

13. The closure of claim 11 wherein the closure is formed from a compression molded polymer.

14. The closure of claim 13 wherein the polymer is a polypropylene homopolymer material.

15. The closure of claim 11 further comprising a plurality of raised ribs extending outwardly from an outer surface of the cylindrical skirt and extending axially along at least a portion of the cylindrical skirt, wherein the number of raised projections is less than the number raised ribs.

16. The closure of claim 11 wherein the angle between a plane defined by the top wall and the outer surface of the transition section is about 40 degrees.

17. A closure comprising:

a planar top wall;

a transition section extending radially outward and downward from a peripheral edge of the top wall;

a skirt extending downward from a peripheral edge of the transition section;

a plurality of raised ribs extending outwardly from an outer surface of the skirt and extending axially along at least a portion of the skirt; and a plurality of raised projections extending outwardly away from an outer surface of the transition section;

wherein a radially innermost segment of each of the plurality of raised projections is coplanar with the top wall, wherein each entire raised projection is located between the peripheral edge of the top wall and the peripheral edge of the transition section.

18. The closure of claim 17 wherein the skirt includes a sidewall section located below a lower end of each of the raised projections and above an upper end of each of the raised ribs, wherein the outer radius of the sidewall section is less than the radius of the outermost surfaces of the plurality of raised ribs, wherein the outer radius of the sidewall section is not less than the outer radius of the raised projections.

19. The closure of claim 17 wherein the skirt includes a sidewall section located below a lower end of each of the raised projections and above an upper end of each of the raised ribs, wherein the outer radius of the sidewall section is less than the radius of the outermost surfaces of the plurality of raised ribs, wherein the sidewall section is a circumferentially contiguous segment of sidewall located immediately adjacent to the peripheral edge of the transition segment.

* * * * *